US008684322B2

(12) United States Patent
Park

(10) Patent No.: US 8,684,322 B2
(45) Date of Patent: Apr. 1, 2014

(54) DEVICE FOR SUPPORTING IN-GROUND SPRINKLER HEADS

(76) Inventor: Joon Park, Glendale, CA (US)

( * ) Notice: Subject to any disclaimer, the term of this patent is extended or adjusted under 35 U.S.C. 154(b) by 328 days.

(21) Appl. No.: 12/218,879

(22) Filed: Jul. 19, 2008

(65) Prior Publication Data

US 2009/0026286 A1 Jan. 29, 2009

Related U.S. Application Data

(60) Provisional application No. 60/961,838, filed on Jul. 24, 2007.

(51) Int. Cl.

| | |
|---|---|
| ***A62C 13/76*** | (2006.01) |
| ***A62C 37/50*** | (2006.01) |
| ***B05B 15/06*** | (2006.01) |

(52) U.S. Cl.

USPC ..... 248/79; 248/85; 248/245; 248/560; 239/201

(58) Field of Classification Search

USPC ..... 239/201, 200, 203, 204, 205; 248/85, 248/245, 560, 75, 76, 79

See application file for complete search history.

(56) References Cited

U.S. PATENT DOCUMENTS

| | | | | | |
|---|---|---|---|---|---|
| 1,646,639 | A | * | 10/1927 | Crowell | 285/123.4 |
| 3,662,956 | A | | 5/1972 | Hedman | |
| 4,274,592 | A | * | 6/1981 | Westhusin | 239/200 |
| 4,683,610 | A | * | 8/1987 | Richards et al. | 16/429 |
| D296,465 | S | * | 6/1988 | Mendoza | D23/214 |
| 4,765,541 | A | * | 8/1988 | Mangels et al. | 239/201 |
| 5,133,501 | A | * | 7/1992 | Marshall | 239/201 |
| 5,253,952 | A | * | 10/1993 | Selway | 404/25 |
| 5,458,290 | A | | 10/1995 | Johnson | |
| 6,494,386 | B1 | * | 12/2002 | Banu | 239/288 |
| 6,695,223 | B2 | * | 2/2004 | Beutler et al. | 239/201 |
| 6,764,025 | B1 | * | 7/2004 | Espina | 239/288 |
| 7,090,257 | B2 | * | 8/2006 | Werth | 285/243 |
| 2005/0023375 | A1 | * | 2/2005 | Tanczos | 239/288 |

* cited by examiner

*Primary Examiner* — Justin Jonaitis

(57) ABSTRACT

A sprinkler support for the in-ground sprinkler heads includes a base at the lower position, a sidewall extending vertically ascending from the base, a clamping structure disposed at the sidewall of the sprinkler support to secure the sprinkler head, a cushioning structure capable to absorb physical stresses, and anchoring structures holding the sprinkler support with respect to the soil. The sprinkler support accommodates a variety of different size of sprinkler heads by having an adapter, by cantilever fingers extended from the sidewall upwardly or by constructing with two halves, wherein each half comprises the base and sidewall.

16 Claims, 4 Drawing Sheets

DEVICE FOR SUPPORTING IN-GROUND SPRINKLER HEADS

CROSS REFERENCE TO RELATED APPLICATION

This application fully incorporates by reference the contents of U.S. Provisional Application No. 60/961,838 entitled "Device for supporting in-ground sprinkler heads" filed Jul. 24, 2007

FIELD OF THE INVENTION

This invention relates to in-ground sprinkler supports, and more particularly to lawn sprinkler supports that protect and hold sprinkler heads.

BACKGROUND OF THE INVENTION

A lawn in-ground sprinkler system typically includes a matrix of buried water pipes, a number of fittings connecting the water pipes, and a sprinkler head. Pressurized water causes a pop-up nozzle to be elevated above ground level for effective disposal of water on a lawn.

The underground lawn sprinkler heads that are recessed into a lawn in residential areas, in large public parks, in sports fields and in golf courses are exposed to physical stresses by lawn mowers, pedestrians and utility vehicles, which result in the sprinkler heads being tilted, compressed down and damaged. Sprinkler head installers have used two methods to partially solve these problems: they install a swing elbow joint or a flexible tube between the sprinkler head inlet and the water supply pipe. These methods minimize damage to the sprinkler heads that are tilted or compressed down if driven over or stepped on, but the sprinkler head repositioning of the sprinkler heads has to be preceded by digging. Even though you use a swing joint the sprinkler head still compresses down and/or tilts if driven over or stepped on. Often, excessive compression results in breakage of the swing joint and/or lateral pipe.

Often, servicing or replacing only a pop-up spray riser requires removing dirt surrounding the sprinkler head followed by grasping cylindrical housing with a hand or with a wrench to separate a cap by turning from a cylindrical housing.

Conventional donut-shaped protectors are shown, for example, in U.S. Pat. No. 3,904,120 to Sbicca, U.S. Pat. No. 4,146,181 to Soos, U.S. Pat. No. 5,211,338 to Leite, et al., U.S. Pat. No. 5,931,385 to Miller, and U.S. Pat. No. 6,209,803 to Colo'n. These protectors tend to be easily dislodged from the ground because they lack withholding means when they are subject to a lateral or vertical impact.

Other cylindrical shaped protectors lack the load bearing capacity, as shown in U.S. Pat. No. 5,938,121 to Ferguson et al., which describes a sprinkler housing that easily compresses downward due to compression from the top while the sprinkler head and fitting become vulnerable to the load, resulting in high stress. The cap-sleeve shoulders, like the conventional donut-shaped protectors, are located just above the topsoil that is unstable and has a less load bearing capability than that of the underground soil. Both the prior art cylindrical and donut-shaped protectors are especially vulnerable against physical stresses.

U.S. Pat. No. 5,213,262 to Violette describes a sprinkler head guard that carries the physical stresses from service vehicles. Since the sprinkler head guard covers a large footing area from top to bottom, facilitating use of this guard results in large areas of grass that need to be removed for the sprinklers.

All prior arts have demonstrated that sprinkler heads are simply rested on sprinkler supports. They do not provide any securing means to hold the sprinkler heads with respect to the sprinkler supports, and there is no provision of cushioning means for the sprinkler heads that are subject to physical stresses.

SUMMARY OF THE INVENTION

The present invention overcomes the disadvantages and shortcomings of prior art and comprises a sprinkler support that has a foothold base at the lower position; a clamping structure to hold a cylindrical housing in an in-ground sprinkler head; a sidewall connecting the base and the clamping structure, and an anchoring structure to hold the sprinkler support with respect to the soil.

It is an objective of this invention to provide a sprinkler support that stabilizes pop-up sprinkler heads, firmly interlocks in the soil and minimizes damage for sprinkler heads including swing joint and lateral pipe.

It is an additional objective of this invention to provide a sprinkler support which accommodates different sizes of the sprinkler head.

It is a further objective of this invention to provide a sprinkler support which prevents the sprinkler head from rotating when removing a cap without requirement of holding a cylindrical housing of the sprinkler head or digging the soil.

It is another objective of this invention to provide a sprinkler support which is easy to install and for both new and buried sprinkler heads.

It is still another objective of this invention to provide a sprinkler support which can absorb physical stresses by cushioning means.

It is yet another objective of this invention to provide a sprinkler support which provides a minimum sectional area near upper end of the sprinkler head to allow growth of grass around it.

Other and related objectives will be apparent from the following description of the invention. The many features and advantages of the present invention will become more apparent from the following detailed description taken in conjunction with the accompanying drawings, which disclose, by way of example, the principles of the invention.

DETAILED DESCRIPTION OF THE EXEMPLARY EMBODIMENTS

Figure 1:
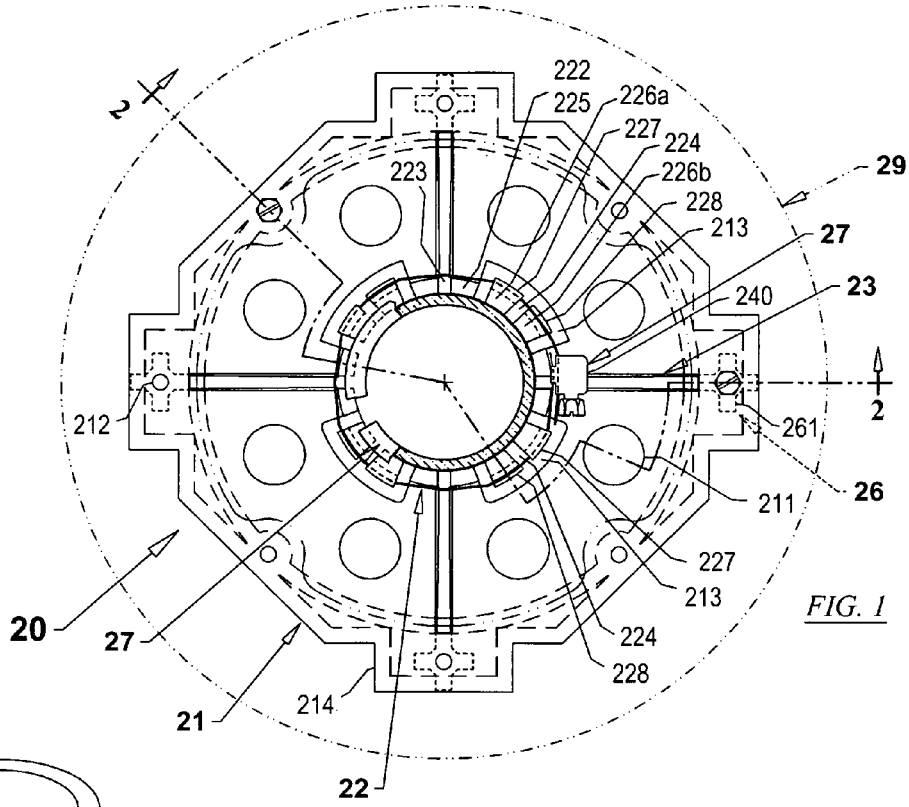
FIG. 1 is a plan view of a sprinkler support implement 10 of an exemplary embodiment.
Figure 3:
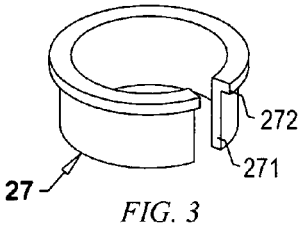
FIG. 3 is a perspective view of an adapter which is to be installed into the sprinkler support 10.
Figure 2:
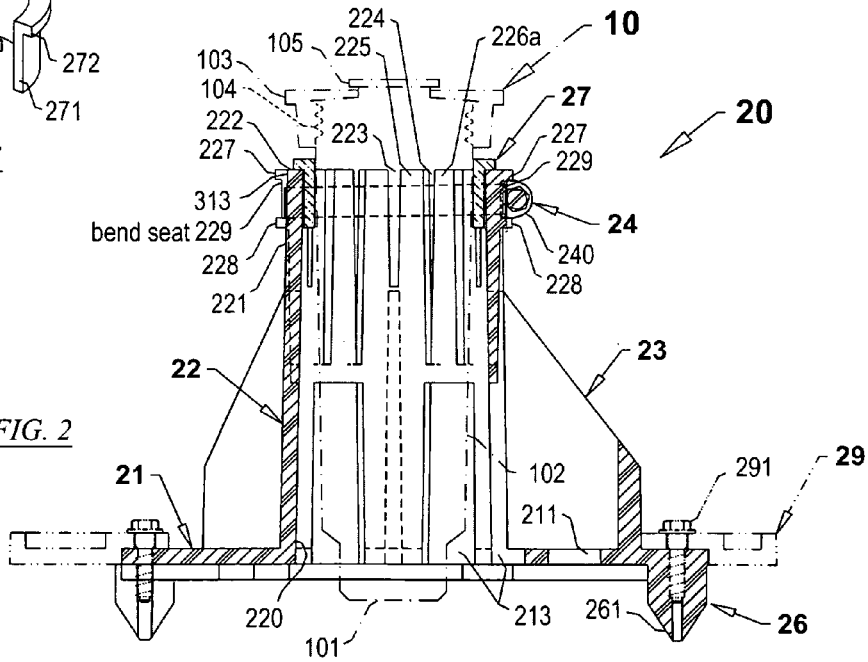
FIG. 2 is a cross-sectional view taken along line 2-2 of FIG. 1, showing a sprinkler head 10 is nested in the sprinkler support 10.

A sprinkler support implement 20 (or a body thereof) of an exemplary embodiment according to the present invention is illustrated as a plan view in FIG. 1, as a cross-sectional elevational view in FIG. 2 and as a perspective view in FIG. 3. One type of pop-up in-ground sprinkler head (hereinafter "sprinkler head") 10 is shown in FIG. 2 as a single-dotted line, which is comprised of a water inlet 101 at a lower end, a cap 103 at an upper end, a cylindrical housing 102 in-between and threads 104 disposed near the upper end of the cylindrical housing 102 and the cap 103. The riser 105 is reciprocatively and coaxially mounted within the cap 103.

Referring to FIGS. 1 and 2, the body 20 is comprised of a base 21; a sidewall 22 extending vertically from the base 21 terminating at a ridge 222; buttresses 23 connecting the base and the sidewall; spikes 261 disposed perpendicular to and underneath the base 21, and a clamping structure 24 that secure the sprinkler head 10 with respect to the body 20.

The base 21 may be adapted to rest on the soil to support the sidewall 22 and may be extended and outwardly from the sidewall 22 in a horizontal direction. The base 21 may be a truncated square-shaped plate having a central opening that receives the housing 102, a plurality of base vertical walls 214, a plurality of through openings 211, a plurality of screw receiving holes 212 and downwardly disposed spikes 261. A plurality of both two-sided openings 213 are formed in base 21 and the sidewall 22.

The sidewall 22 may be a tubular shape that receives the cylindrical housing 102 and at its upper position may have a plurality of vertical shallow slots 223, vertical deep slots 223, which may form a plurality of short cantilever fingers 225 and of long cantilever fingers 226*a* and 226*b*. Each cantilever finger 226*a* and 226*b* may have a radially extending upper tab 227 and lower tab 228, and a radially disposed protrusion 229 whose radius is slightly larger than that of the outer wall 221 and is slightly smaller than that of the tabs 227 and 228.

FIG. 3 shows the adapter 27 may be ring-shaped and inverted L-shaped at its cross section, and may have a cylindrical wall 271 and a radially extended flange 272. The adapter 27 may be a rectangular, round, triangular shape at its cross section, which may vary to conform to the shape of the cylindrical housing 102. The cushioning structure may be comprised of elastomeric adapter 27 or an elastomeric washer placed in between above ridge 222 and underneath the cap 103. By selecting proper thickness of the wall 272, the body 20 can accommodate a wide diametric range of the different head 10.

As shown in FIGS. 1 and 2, as the hose clamp 240 is being tightened, the long fingers 226*a* and 226*b* bend inwardly followed by bending of the short fingers 225 to secure the head 10 with respect to the body 20. The head 10 can be new or existing in the lawn and the installation of the body 20 may be as follows: remove by turning the cap 103 from the housing 102; place the adapter 27 around the housing 102, if the adapter 27 does not have the flange 272; drop the body 20; insert the adapter in between an inner wall 220 and the housing 102; and tighten by turning the hose clamp 240.

The clamping structure 24 may include the cantilever fingers 225, 226*a* and 226*b*, the adapter 27 and a hose clamp 240 that is held vertically in between the upper tab 227 and the lower tab 228.

The anchoring structure 26 may include spikes 261, buttresses 23 and base vertical walls 214, openings 211 and two-sided openings 213 with soil filled among them, which resist from rotating the body 20. Roots of the lawn that pass through the openings 211 and spikes (not shown) that pass through the openings 211 help firmly anchor the body 20 into the soil.

An enlarged base 29, shown as double dotted line, may be mounted to the base 21 by screws 291 for more load bearing capability and stability of the body 20 in the soil, which is especially helpful where the soil stays wet, is sandy or is unstable.

It is frequently practiced that one hand or a wrench holds the housing 102 while the other hand or a wrench turns the cap 103 for the service of the riser 105. But with the provision of the clamping structure 24 and the anchoring structure 26, it is not necessary to dig around head 10 to remove by turning the cap 103 from the housing 102, because the clamping structure 24 holds the housing 102 with respect to the body 20 and the anchoring structure 26 holds the body 20 with respect to the soil. Furthermore, the base walls 214 act as anti-spinning wall when the cap 103 is being rotated for the service of the riser 105.

Figure 4:
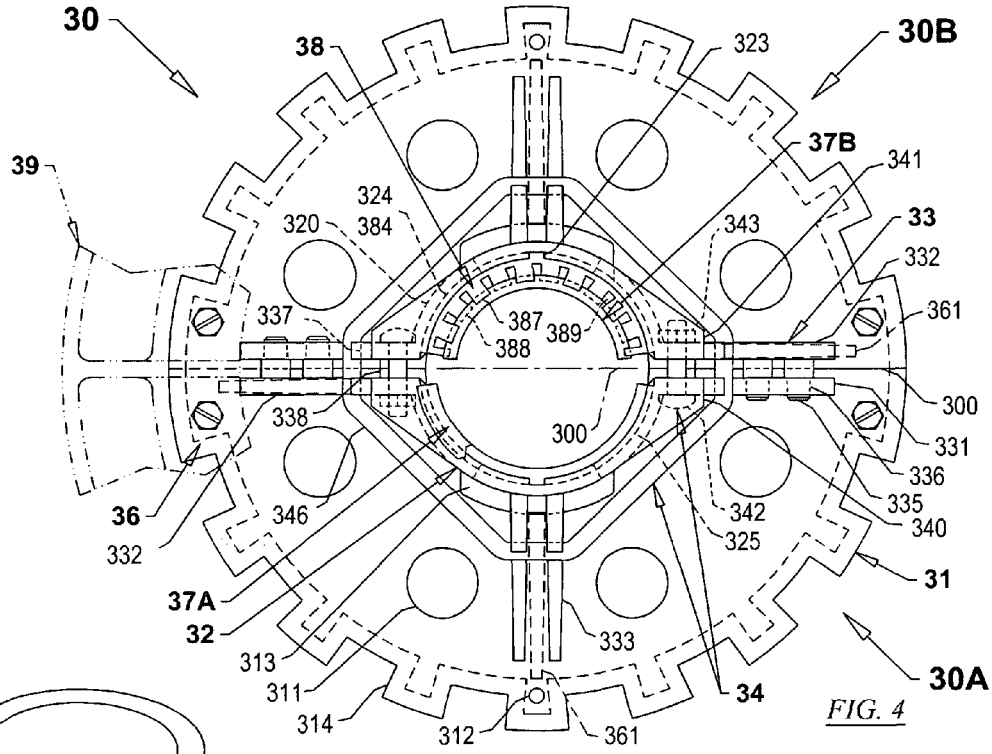
FIG. 4 is a plan view of a sprinkler support implement 30 of another exemplary embodiment, which shows two halves 30A and 30B forming a complete sprinkler support 30.
Figure 6:
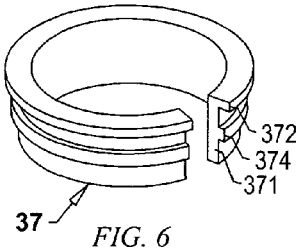
FIG. 6 is a perspective view of a first adapter 37 which is to be mounted into the sprinkler support 30.
Figure 5:
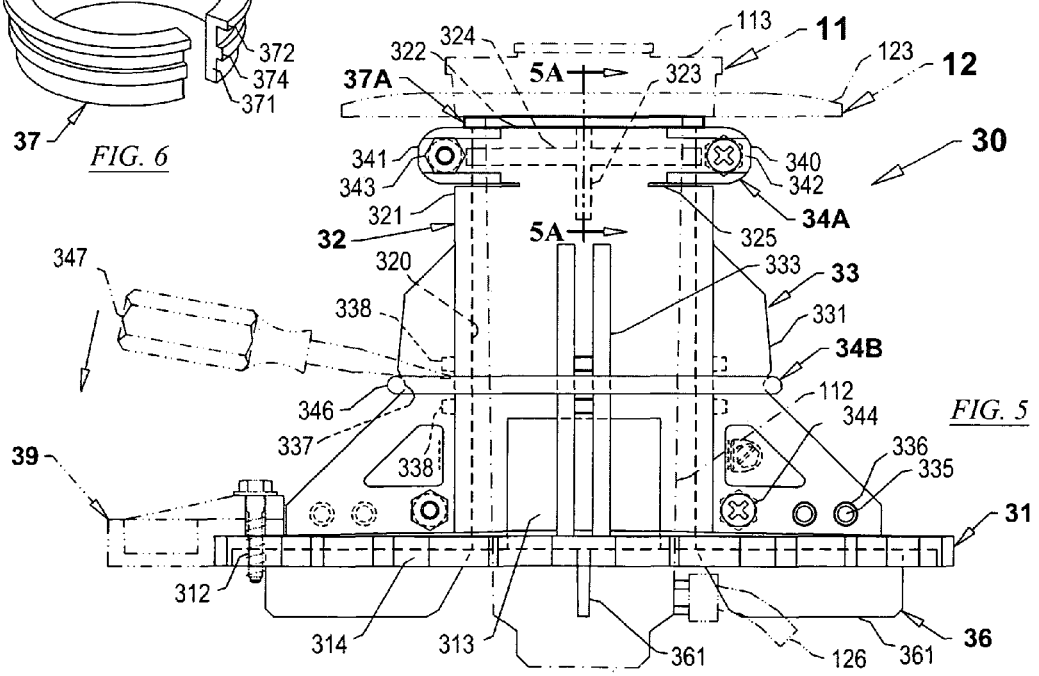
FIG. 5 is an elevational view of FIG. 4, showing sprinkler heads 11 and 12 that are disposed in the sprinkler support 30.
Figure 5A:
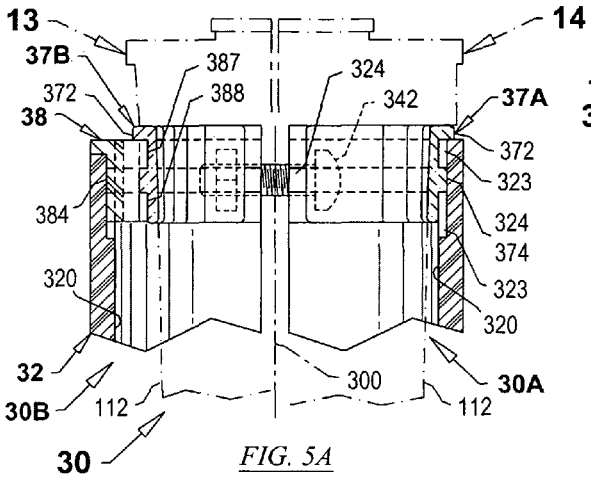
FIG. 5A is an enlarged and cross-sectional view taken along line 5A-5A of FIG. 5, showing that two adapters, 37B and 38, are placed in between a sidewall 320 and a sprinkler head 13 in the left-handed side, and an adapter 37A is placed in between a sidewall 320 and a sprinkler head 14 in the right-handed side.
Figure 7:
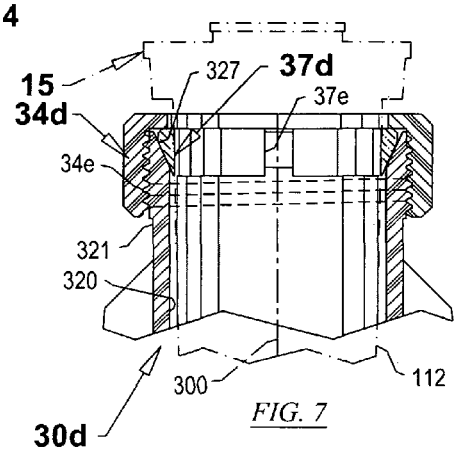
FIG. 7 is a cross-sectional view similar to FIG. 5A, showing that a tapered split ring 37*d* is disposed in between a sidewall and a tubular nut 34*d* to secure a sprinkler head 15.

A sprinkler support implement 30 (or a body thereof) of another exemplary embodiment according to the present invention is illustrated as a plan view in FIG. 4, as an elevational view in FIG. 5, as a perspective view in FIG. 6, as an enlarged view in FIG. 5A, and a cross-sectional view in FIG. 7. Two types of sprinkler head 11 (shown as single-dotted line) and 12 (shown as double-dotted line) are shown in FIG. 5, whose caps are different in shape; the head 11 may have a removable cap 113 and the head 12 is fixed with a cylindrical housing 112 having a peripheral flange 123 which extends laterally outwardly at the upper end to provide a ground support surface and may have a control line 126 at the lower end.

Referring to FIGS. 4 and 5, the body 30 is comprised of a base 31; a sidewall 32 extending vertically from the base 31 and terminating at a ridge 322; buttresses 33 connecting the base and the sidewall, and clamping structures 34A and 34B that secure the head 11 or 12 with respect to the body 30.

The base 31 may be a round-shaped plate and having a central opening that receives the head 11 or 12, a plurality of radially positioned base vertical walls 314, a plurality of through openings 311, a plurality of screw receiving holes 312, and downwardly and radially extended fins 361. Both two-sided openings 313 are formed in the base 31 and the sidewall 32.

The sidewall 32 may be tubular in shape that receives the housing 112. The upper position of the sidewall 32 may have a set of laterally extended wing 340 for receiving a screw 342 and two laterally extended wing 341 for receiving (wing) nut 343, which is bendable tangentially when the screw 342 is tightened with respect to the sidewall 32 since lateral slits 325 are formed therein. The upper position of an inner wall 320 may have two oppositely disposed vertical grooves 323 and annular grooves 324, which may conform to a specific sprinkler head 11 configuration, or to retain a first adapter 37 and a second adapter 38 depending on the diametric variation of the heads 11 and 12.

FIG. 6 shows a first circular adapter 37 that is ring-shaped and 'F'-shaped at its cross section. The adapter 37 also may be rectangular, round, triangular, or 'L'-shaped at its cross section, which may vary to conform to the shape of the heads 11 and 12 and the inner wall 320. The adapter 37 may have a cylindrical wall 371, a radially extended flange 372 and a radially extended rib 374.

It should be understood that a half body 30A shown in FIG. 4 is exactly the same as the other half body 30B; they are assembled along an axial plane 300 to form the body 30. Even though a first segmental adapter 37A is mounted on the half body 30A, it should be understood that the other half body 30B has the same first segmental adapter 37A to form a complete the body 30.

As shown in FIGS. 4, 5 and 5A a circular segment of the first adapter 37A is mounted in the grooves 323 and 324 and on the ridge 322, which may accommodate a slightly smaller diametric cylindrical housing 112. To accommodate a further smaller diametric cylindrical housing of the head 13, the second adapter 38 may be disposed in between the inner wall 320 and the first adapter 37A. The second adapter 38 may be a circular segment that fits into the grooves 323 and 324 and may have upper tabs 387 and lower tabs 388 that are disposed inwardly in a radial direction. The vertical space in between tabs 387 and 388 forms another annular groove in which the rib 374 of the first segmental adapter 37B retains. A plurality of vertical slits 389 is disposed inwardly in the second adapter 38 to bend easily when the body halves 30A and 30B are fastened with the screws 342. FIG. 5A shows a sprinkler head 13, shown in the left-handed side, whose housing diameter is much smaller than that of the inner wall 320, and a sprinkler head 14, shown in the left-handed side, whose housing diameter is slightly smaller than that of the inner wall 320.

There is the radially extended flange or a cushion ring 372, as shown in FIG. 5A, in between the sidewall 320 and the cap 13 or 14, which can absorb physical stresses or impacts from the cap 13 or 14.

FIG. 7 shows another clamping structure having a tapered split ring 37*d* that is disposed in between housing 112 and the inner wall 320 whose upper position having a corresponding taper 327. A tubular nut 34*d* may compress the ring 37*d* downwardly, which results in holding the head 15 with respect to the modified body 30*d*, wherein threads 34*e* are disposed in the outer wall 321 and the nut 34*d*. The inner diameter of the nut 34*d* has to be larger than the thread diameter at upper position of the housing 112.

The body 30 and the modified body 30*d* can accommodate a wide diametric range of the different heads 11 or 12 by selecting and combining the proper radial wall thickness of the adapters 37A, 37B, 38 and 37*d*.

The advantage of having two halves 30A and 30B to make a body 30 is that the cap 113 or the flange 123 does not need to be removed from the housing 112. At least a pin 335 is disposed tangentially on a buttress 332 and a pin-receiving hole 336 is formed in a buttress 331, which helps align the halves 30A and 30B together and they are located near or above the base 31. The halves 30A and 30B may be assembled together with the head 11 by fastening screws 342 and 344, which may be defined as a first clamping structure 34A. A truncated square ring 346 may replace a set of screws 344, which may be defined as a second clamping structure 34B. Each buttress 331, 332 and 333 may have a ring seat 337 in between the base 31 and under the lateral slits 325, which may receive the ring 346. At least a horizontal tab 338 is disposed outwardly from the outer wall 321 in between two adjoining buttresses, which helps install and remove the ring 346 by pushing/pulling a flat-blade screwdriver 347 with leverage. The clamping structures 34A and 34B may be replaced with the hose clamps 240 as shown in FIGS. 1 and 2.

The clamping structure 34 may include the wings 340 with screws 342 and nuts 343, the adapter 37 that is disposed in between the heads 11 or 12 and the inner wall 320, pins 335 in associate with holes 336, the ring 346, which help hold the housing 112 with respect to body 30.

The anchoring structure 36 may include fins 361, buttresses 33, base vertical walls 314, openings 311 and two-sided openings 313. The root of the lawn that passes through openings 311 and two-sided openings 313 and soil filled among them help firmly anchor the body 30 into the soil.

An enlarged base 39, shown as the double-dotted line, may be attached onto the base 31 by screws for more load bearing capability and stability of the body 30 in the soil, which is especially helpful where the soil stays wet, is sandy or is unstable.

Figure 8:
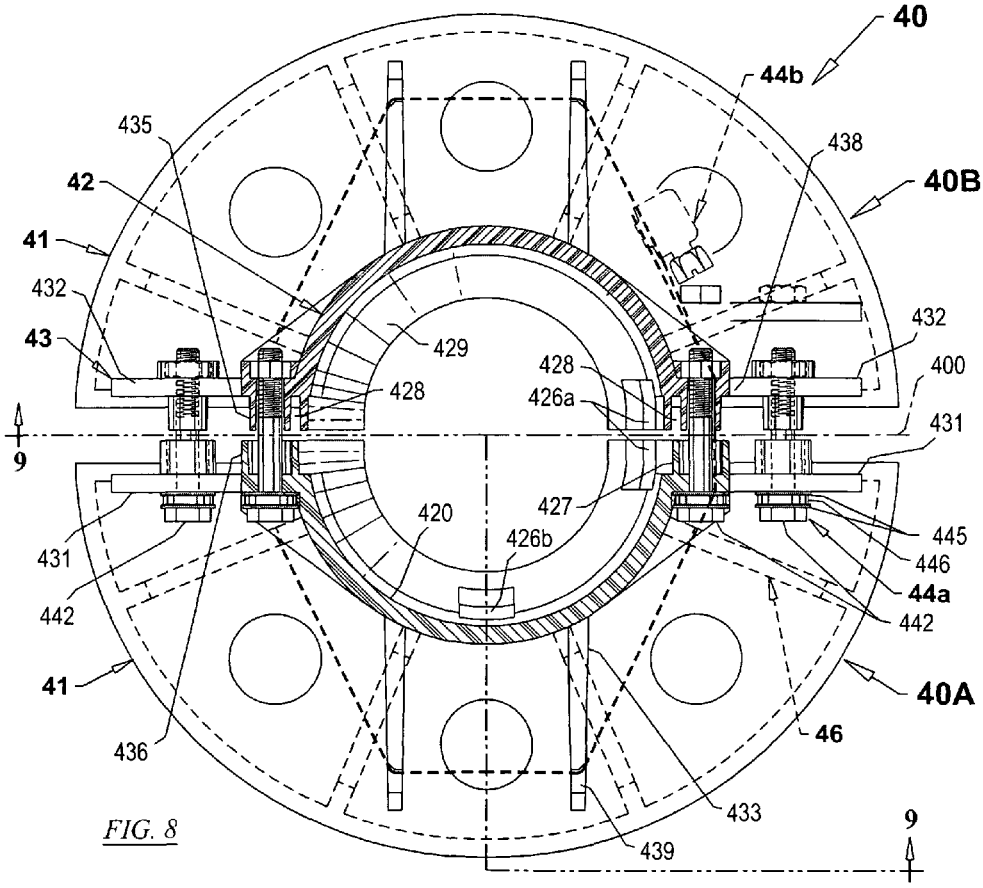
FIG. 8 is a cross-sectional view taken along line 8-8 of FIG. 9 and is a sprinkler support implement 40 of still another exemplary embodiment, which shows two halves 40A and 40B forming a complete sprinkler support 40.
Figure 9:
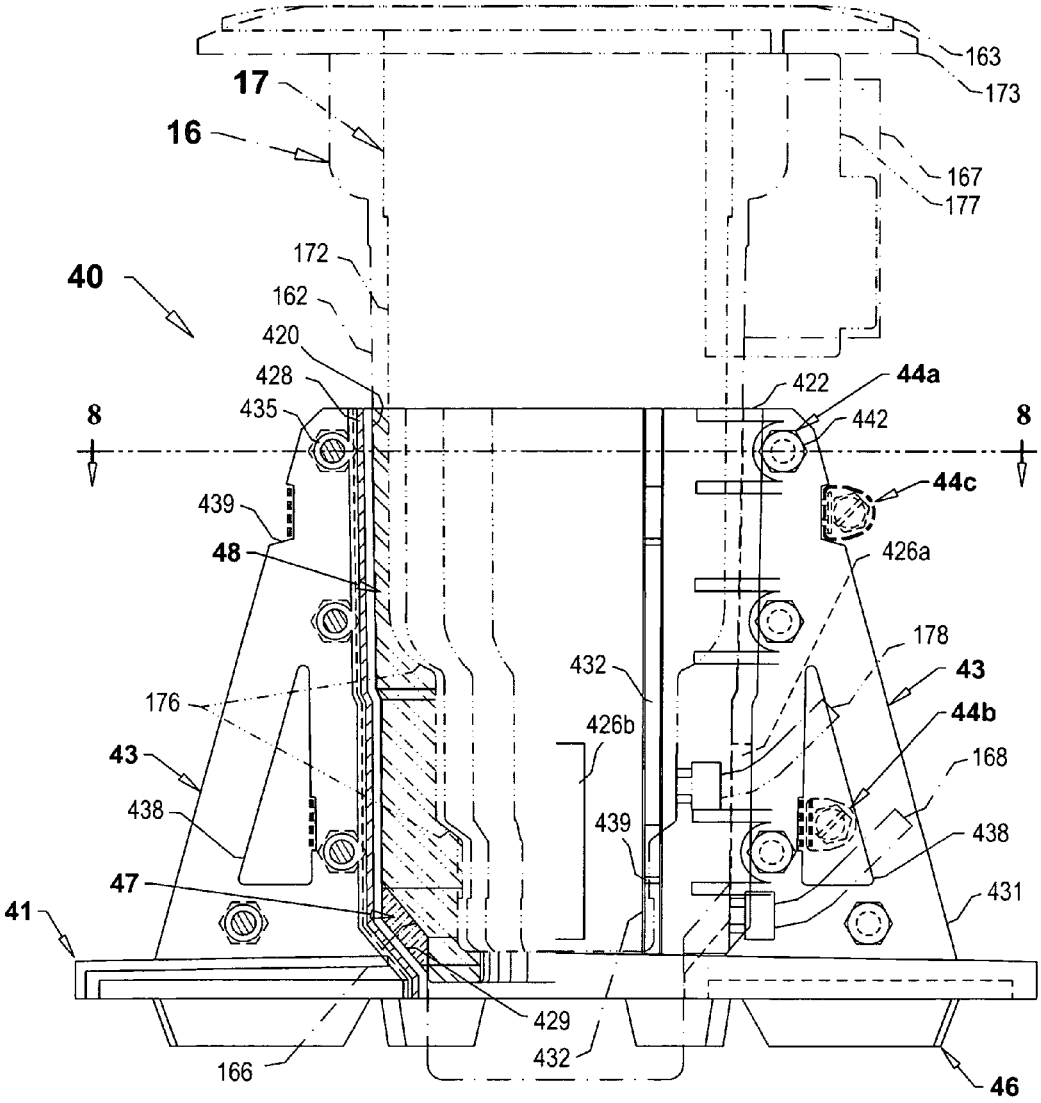
FIG. 9 is a cross-sectional and elevational view taken along line 9-9 of FIG. 8, showing two different sprinkler heads 16 and 17 that are mounted in a sprinkler support 40.
Figure 10:
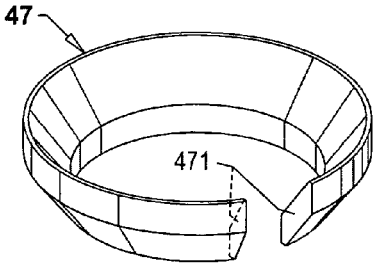
FIG. 10 is a perspective view of a cushion ring which is to be placed in between the sprinkler support 40 and a sprinkler head 16.

A sprinkler support implement 40 (or a body thereof) of yet another exemplary embodiment according to the present invention is illustrated as a plan view (plane view???) in FIG. 8, as an elevational view in FIG. 9, and as a perspective view in FIG. 10. Two types of pop-up sprinkler head 16 (shown as single-dotted line) and 17 (shown as double-dotted line) are mounted in a sprinkler support 40, as shown in FIG. 9, whose axial length and cylindrical diameter are different. Each sprinkler head 16 and 17 has a peripheral flange 163 and 173 at the upper position, a valve assembly 167 and 177 underneath the flange, tubing 168 and 178 at the lower position, and annular steps 166 and 167 in the housing 162 and 172, respectively.

The body 40 as shown in FIGS. 8 and 9 is similar to the body 30 as shown in FIGS. 4 and 5, which may be assembled with respect to an axial plane 400. The similarities of the two are that they are constructed with two body halves 40A and 40B, have a base 41, have a sidewall 42, have buttresses 43, have clamping structures 44*a* and 44*b*, have anchoring structures 46 and 43, have a cushion ring 47, have alignment pins 435 and corresponding tubular tabs 436, and have an adapter 48 to accommodate different sprinkler heads 17. The differences between them are that the body 40 utilizes the cylindrical housing 162 and 172 for support not peripheral flanges 167 or 177 because of an obstruction; valve assembly 167 or 177 has a lateral clearance 426 for tubing 168 and 178; and have all screws 442 positioned from one side.

The shape of the cylindrical housings 162 and 172 may have slightly tapered surface downwardly and may have at least one annular step 166 and 176, as shown in FIG. 9.

Referring to FIGS. 8 and 9, the body 40 is comprised of a base 41; a sidewall 42 extending vertically from the base 41 and terminating at a ridge 422; buttresses 43 connecting the base and the sidewall, and clamping structures 44*a* or 44*b* that secure the head 16 or 17 with respect to body 40.

The base 41 may be a round-shaped plate having a central opening that receives the head 16 or 17 and may have downwardly and radially extended fins 46.

The sidewall 42 may be tubular in shape that may conform to the contour of a cylindrical housing 162 and terminates at the ridge 442 that is beneath the assembly 167. A lateral clearance 426*a* may be disposed in the sidewall 42, located above the base 41, in between two opposite buttresses 431 and 432. Alternatively, another lateral clearance 426*b* may be disposed perpendicular to the axial plane 400.

The two oppositely disposed buttresses 431 in the half 40A may have through holes perpendicular to the axial plane 400 for use with screws 442 and tubular tabs 436 that receive alignment pins 435 formed in buttresses 432 in the half 40B, which provide alignment of the two halves and shear resistance between the two halves 40A and 40B. The half 40A may have two oppositely disposed vertical tongues 427 that are parallel to the plane 400, offset from a inner wall 420. The other half 40B may have two corresponding vertical grooves 428, shown as cross hatched lines in FIG. 9, which help the body 40 form an integral unit and prevent sand, dirt or lawn roots from seeping in.

FIG. 10 shows a split cushion ring 47 whose cross section is a parallelogram having ring ends 471, which are shaped to fit onto the inwardly downwardly extended seat 429 and the annular step 166 in the housing 162 as shown in FIG. 9. The opening between ends 471 provides a clearance for the control line 168 and 178.

FIG. 9 shows that the ring 47 is disposed under the annular step 166 of the head 16. The space between the inner wall 420 and the housing 172 is indicated as double-dotted line hatch, which is a tubular shape that holds an adapter 48. The adapter 48 may be constructed with two similar-shaped pieces that may have a split plane that is the same as the plane 400 and may have a lateral clearance for the tubing 178.

As shown in FIGS. 8 and 9, the two halves 40A and 40B may be assembled by screws 44*a* and (wing) nuts or by hose clamps 44*b* and 44*c*. A band of hose clamps 44*b* may be disposed inside of openings 438 disposed in the buttresses 431 and outside of the buttresses 439. A ring 346, shown in FIGS. 4 and 5, may replace the hose clamps 44*b* and 44*c*. The clamping structure may be comprised of fasteners 44*a*, hose clamps 44*b* and 44*c*, and a ring(s) 346 as shown in FIGS. 4 and 5.

A resilient washer 446 may be inserted in between two ferrous washers 445 for the clamping structure 44*a*, wherein the resilient washer 446 can absorb a slight radial expansion, which may take place when the head 16 or 17 is subject to vertical stress. Use of the resilient washers 446 and the cushion ring 47 helps to absorb physical stresses or impacts from the cap 163 or 173. The cushioning structure may be comprised of elastomeric ring 47, elastomeric adapter 48 and resilient washer 446.

The anchoring structure 46 in the body 40 is very similar to that of the body 30 as shown in FIGS. 4 and 5.

The commonalities of the bodies 20, 30 and 40 are that they provide the clamping structures that secure the sprinkler heads with respect to the bodies, the cushioning structures that help absorb physical stresses or impacts, the anchoring structures that hold the bodies with respect to the soil, and versatility to use for both new and existing sprinkler heads. Use of two halves in the bodies 30 and 40 provides convenience, versatility and helps to overcome any obstructions.

Most structures shown in FIGS. 1 through 10 can be constructed with economic thermoplastic materials such as ABS, polypropylene, polyethylene, polystyrene or PVC, and with cast aluminum or concrete.

Any suitable elastomeric material that can absorb physical stresses or, impacts such as Santoprene™ made by Monsanto may be used for the adapter 27 (FIGS. 1-3), adapter 37 (FIGS. 4-5A), tapered ring 37*d* (FIG. 7), elastomeric washers 446 (FIG. 8), and cushion rings 47 and 48 (FIGS. 9 and 10).

Due to corrosion in the environment by wet soil and moisture, all ferrous materials including fasteners, the ring 346, and hose clamps should be stainless steel or be hot-dip galvanized.

It will be appreciated by those of ordinary skill in the art that the invention can be embodied in other specific forms without departing from the spirit or essential character hereof. The present description is therefore considered in all respects to be illustrative and not restrictive. The scope of the invention is indicated by the appended claims, and all changes that come within the meaning and range of equivalents thereof are intended to be embraced therein.

The invention claimed is:

1. A device for supporting an in-ground sprinkler head comprising:

a body having an upper end and a lower end;

a sidewall disposed at the body and adapted to receive a cylindrical housing of the sprinkler head, the sidewall being straight between the upper end and the lower end;

a plurality of cantilever fingers disposed at the upper end of the sidewall;

at least two tabs extended radially, each tab disposed at a ridge of the cantilever finger;

a base disposed near the lower end, which is perpendicular to and extends outwardly from the sidewall; and a clamp disposed outside of the cantilever fingers to secure the sprinkler head with respect to the body, thus the tabs prevent the clamp from dislocating above the ridge.

2. The device of claim 1 wherein the clamp is a hose clamp.

3. The device of claim 1 further comprising a ring-shaped adapter sized to fit the inside of the sidewall.

4. The device of claim 1 further comprising at least one buttress disposed between the sidewall and the base.

5. The device of claim 1 wherein the sidewall is circular shaped.

6. The device of claim 1 wherein the body comprises two halves, wherein each half comprises the sidewall and the base.

7. A device for supporting an in-ground sprinkler head comprising:

a body having two halves which have an upper end and a lower end;

an axial plane formed by the upper end and the lower end;

a sidewall disposed at each half and adapted to receive a cylindrical housing of the sprinkler head;

a plurality of cantilever fingers formed at the upper end, at least two tabs extended radially and each tab disposed at a ridge of the cantilever finger;

at least one pin tangentially positioned and disposed at the one half at least one hole configured to receive the pin at the other half, wherein the pin and the hole help align the two halves together;

at least one clamping structure to fasten the two halves together; and a base disposed at each half, the base being perpendicular to and extending outwardly from the sidewall.

8. The device of claim 7 wherein the clamping structure comprises at least one of a hose clamp, a bolt, or a ring.

9. The device of claim 7 further comprising a ring-shaped adapter sized to fit inside of the sidewall, wherein the adapter is made of an elastomeric material.

10. The device of claim 7 further comprising at least one buttress connecting the sidewall and the base.

11. The device of claim 7 wherein the pin comprises at least one of a protrusion or a screw.

12. The device of claim 7 further comprising an enlarged base attached to the base to increase load bearing capability and stability of the body in the soil.

13. A device for supporting an in-ground sprinkler head comprising:

a body having an upper end and a lower end;

a sidewall disposed at the body and adapted to receive a cylindrical housing of the sprinkler head;

a base disposed near the lower end, which is perpendicular to and extends outwardly from the sidewall; and a ring-shaped adapter sized to fit between the cylindrical housing and the sidewall, made of an elastomeric material and split axially.

14. The device of claim 13 wherein the shape of the cross-section of the ring-shaped adapter comprises at least one of a rectangle, a round, a triangle, a parallelogram, a "F" or a "L".

15. The device of claim 13 further comprising an axial plane formed by the upper end and the lower end so that the body is constructed with two halves with respect to the axial plane, wherein each half comprises the sidewall and the base.

16. The device of claim 13 further comprising a plurality of cantilever fingers disposed at the upper end of the sidewall, at least two tabs extended radially, each tab disposed at the ridge of the cantilever finger and a clamp disposed outside of the cantilever fingers.

* * * * *